United States Patent [19]

London et al.

[11] 4,363,388

[45] Dec. 14, 1982

[54] GARMENT BAG UNIT

[75] Inventors: Wallace London, 641 S. Monroe St., Baltimore, Md. 21223; Kurt L. Meyer, Ellicott City, Md.

[73] Assignee: Wallace London, Baltimore, Md.

[21] Appl. No.: 282,714

[22] Filed: Jul. 13, 1981

[51] Int. Cl.[3] ..... A45C 3/00; B65D 85/18; A44B 21/00

[52] U.S. Cl. ..... 190/41 B; 206/285; 206/287; 24/248 B

[58] Field of Search ..... 190/41 R, 41 B, 41 Z, 190/43; 206/279, 285, 286, 287; 24/248 B; 211/124, 123, 94

[56] References Cited

U.S. PATENT DOCUMENTS

| | | | |
|---|---|---|---|
| 2,352,102 | 6/1944 | Johnston | 206/285 |
| 2,893,545 | 7/1959 | Garfunkel | 206/279 |
| 3,273,678 | 9/1966 | Koret | 190/41 B X |
| 3,566,456 | 3/1971 | London | 206/285 X |
| 4,252,220 | 2/1981 | London et al. | 190/41 B |

*Primary Examiner*—William Price
*Assistant Examiner*—Sue A. Weaver
*Attorney, Agent, or Firm*—Samuel Lebowitz

[57] ABSTRACT

A framed garment bag with flexible walls having exterior suspension means at the top thereof and a jointed clamp formed of a pair of pivoted channels disposed in a substantially vertical plane on the interior thereof. The upper channel of the clamp which is fixed to the underside of the top, and the lower channel which is pivoted to the rear end of the former, are fitted with contiguous edges of yieldable material which effect a tight retention of the hooks of the garment hangers disposed therebetween when the channels are clamped together in a plane parallel to the top of the frame of the bag. The upper edge of the yieldable material in the lower channel is serrated or roughened to enhance this retention as well as to provide an impediment to the movement of hooks of the hangers when the lower channel lowered to a limited extent is an inclined position for loading or unloading. The bottom web of the lower channel is provided with a slot to accommodate the shanks of one or more hookless garment hangers of the type found in hotel closets, when a need therefor arises. Also, the downward inclination of the lower channel is controlled by a vertical stem or by a continuous band surrounding the channels at their pivoted end, which cooperate with the hinge pin pivotally joining said channels.

14 Claims, 11 Drawing Figures

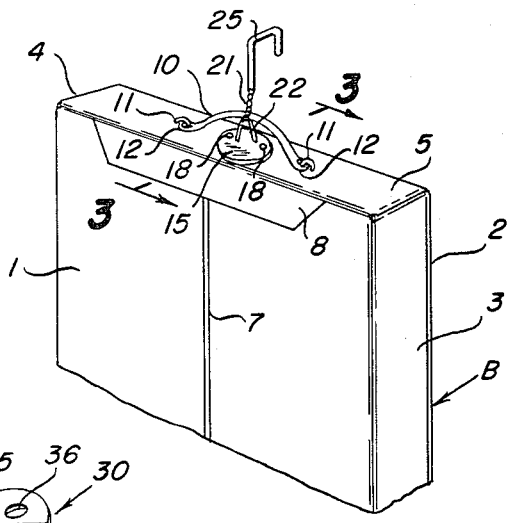
Fig. 1
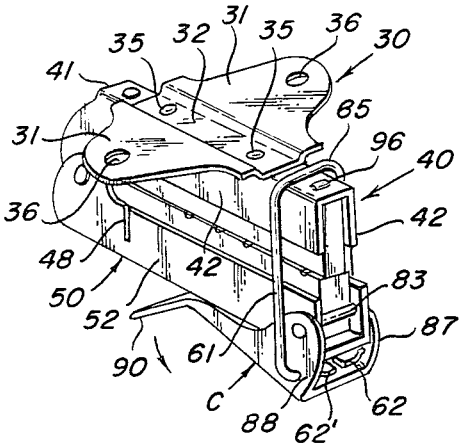
Fig. 2
Fig. 3
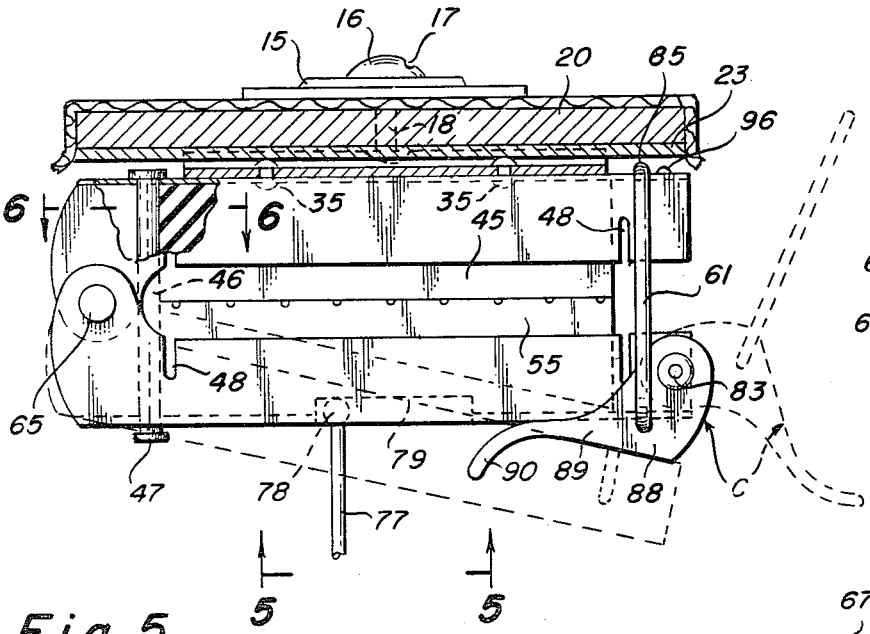
Fig. 4
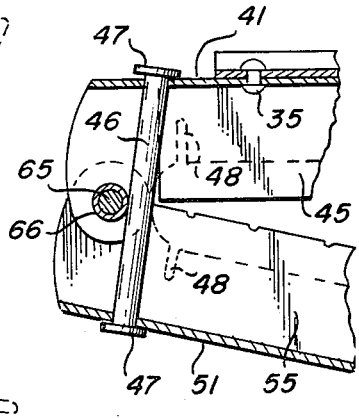
Fig. 5
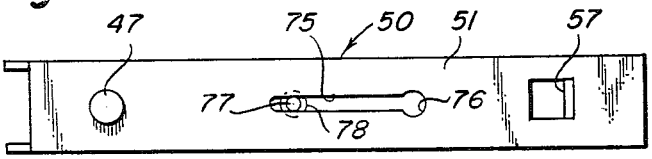
Fig. 6
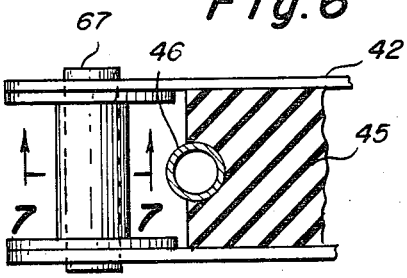

GARMENT BAG UNIT

This invention relates to a garment bag unit and particularly one capable of accommodating one or several garment hangers supporting different items of clothing which are adapted to be housed in their entirety within the garment bag.

It is the object of the present invention to improve upon the garment bag assembly disclosed in the recently issued U.S. Pat. No. 4,252,220, Feb. 24, 1981.

It is a further object of the present invention to provide an improvement garment bag unit which incorporates therein an improved garment hanger clamp of the type covered by U.S. Pat. No. 3,566,456, issued to one of the coinventors herein, namely, Wallace London, on March 2, 1971. The special mounting of the jointed clamp in the garment bag makes possible the convenient and rapid loading and unloading of the garments into and from the garment bag and the suspension of the garments on hangers with no protrusion of any parts of the latter from the garment bag, as was the case in the earlier patented construction.

It is a further object of the invention to provide a secure clamp for the hooks of the wire hangers so that they cannot be dislodged therefrom, no matter how roughly the garment bag may be handled in transport.

It is another object of the invention to provide a rugged and reliable unit which may be incorporated within garment bags in the course of their manufacture, or which may be applied to finished garment bags.

One of the improvements of the instant invention over that in patent No. 4,252,220, reside in the adaptability of the garment bag unit to support and house garment hangers which do not have curved supporting hooks at the tops thereof, that is, those which consist of simple wire shanks fitted with bulbous enlargements at the upper ends of the shanks, which are designed to detachably engage slotted receptors mounted on horizontal cylindrical closet bars. Such hangers are found in hotels and motels and may be used when conventional garment hangers are unavailable.

Furthermore, the invention seeks to simplify the interconnection between the upper and lower channels of the clamp unit to limit the opening movement therebetween in the course of loading and unloading the garment hangers therein and to reenforce the construction of the assembly. Also, the upper surface of the resilient block in the lower channel is designed to reduce the sliding of the hanger hooks therealong in the course of such operation.

Other objects and purposes will appear from the detailed description of the invention following hereinafter, taken in conjunction with the accompanying drawings, wherein FIG. 1 is a perspective external view of the improved garment bag in accordance with the invention;

FIG. 2 is a perspective view of the improved clamp adapted to be mounted to the top wall of the garment bag on the interior thereof;

FIG. 3 is a vertical sectional view along line 3—3 of FIG. 1;

FIG. 4 is a vertical sectional view of the rear portion of FIG. 3, showing the channels in open position as indicated in dotted lines in FIG. 3;

FIG. 5 is a bottom view of FIG. 3, illustrating the capability of the clamp to suport simple garment hangers having vertical stems terminating in bulbous enlargements;

FIG. 6 is a horizontal sectional view along line 6—6 of FIG. 3;

Figure 7:
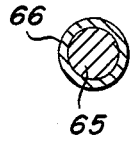
FIG. 7 is a vertical sectional view along line 7—7 of FIG. 6.

FIG. 1 of the drawings shows the upper portion of a garment bag B formed of flexible walls provided with means on the top thereof for suspending the bag while loading and unloading the same with garments of long or short lengths, which are designed to be housed therein, and which are adapted to be carried either in an extended condition or which may be folded for more convenient transport.

Such bags have come into extensive use in recent years and may be provided with slide fastener closures, multiple pockets for storage of items complementary to the garments housed in the bag, latching and strapping devices, handles at one or both ends of the bags, etc., none of which features are germane to the instant invention. Such garment bags are fully disclosed in the following patents and are illustrative of a voluminous amount of art in this highly developed field:

U.S. Pat. No. 2,606,636, Aug. 12, 1952
U.S. Pat. No. 2,671,706, Mar. 9, 1954
U.S. Pat. No. 2,689,631, Sept. 21, 1954
U.S. Pat. No. 2,862,586, Dec. 2, 1958
U.S. Pat. No. 3,221,848, Dec. 7, 1965
U.S. Pat. No. 3,958,675, May 25, 1976

The garment bags shown in the above-noted patents disclose different confining arrangements, for the hooks of the garment hangers, of varying designs and complexity, none of which has proven totally capable of preventing at least some of the hangers from working loose from their confinement and ultimately dropping into the bag with the consequent wrinkling and crushing of the clothing. The instant invention eliminates this problem with certainty.

As shown in FIG. 1, the garment bag in accordance with the present invention may be fabricated from any suitable waterproof and wear-resistant material of fabric, leather or plastic sheeting, or combination thereof. The bag is comprised of a flexible front wall 1, rear wall 2, lateral walls 3 and 4, and top and bottom walls 5. The bag may be shaped by an inner frame member 20 which extends across the top 5 and, if desired, partially along the upper portions of the lateral walls 3 and 4. The frame 20 may be formed of any rigid material such as plywood, metal, plastic or combinations thereof, and the flexible covering of the top wall and upper portions of the sides may be integrated to the frame 20 by gluing, riveting, or other modes of joining.

A slide fastener 7 may be provided at the center of the front wall which extends to the top to subdivide the front wall into two parts to permit ready access to the interior of the bag. The opening at the top of the front wall may be covered by a flexible flap 8, extending from the front edge at the top 5.

As an alternative to the single central slide fastener 7 shown in FIG. 1, multiple slide fasteners or a slide fastener extending in multiple directions, may be provided as shown in the patents enumerated above.

In FIG. 1 is shown a handle 10 for transporting the bag, the ends of which may be looped at 11 and confined within retainers 12 which are riveted to the frame member 20 and top wall 5, as well as to any interior lining 23 below the frame member. The integration of these components is also supplemented by the mounting of a central escutcheon plate 15 which is fastened to the center of the top wall 5 by means of rivets 18 which likewise extend through the outer fabric on top wall 5, frame member 20 and the internal lining 23 on the latter. The rivets 18 also extend through the apertures 36 in mounting plate 30 to which is affixed the upper channel of the jointed clamp, as described fully hereinafter.

The plate 15 seats a movable spherically-shaped member 16 provided with recesses 17 into which may be inserted a detachable handle member for suspending the garment bag from a wall hook, closet foor, or the like, in the course of loading or unloading the garment bag. The hook 25 is connected to one end of a chain 21, the other end of which is fitted with a spring hook 22 adapted to detachably engage the openings 17 of the member 16. This hook support is readily detachable from the bag for transport, all as well known in the art, and as disclosed in the above-mentioned patents.

The mounting plate 30 for the improved clothes hanger clamp is affixed to the inner surface of the frame member 20 centrally of the garment bag. As stated above, this may be done by riveting, such as by rivets 18 passing through openings 36 in the ends of the wings 31 on the opposite sides of the plate 30. Any other type of fastening may be used, such as welding, brazing or bolts and nuts. A slight elongated depression 32 at the center of the plate 30 accommodates headed fasteners 35, which may be rivets, to affix the web 41 of upper channel 40 to the underside of plate 30.

The jointed clamp disclosed in earlier U.S. Pat. No. 3,566,456 has been improved in many respects to render it capable of withstanding the heavier loads imposed upon it by virtue of its mounting on plate 30 within the garment bag in a substantially vertical plane. The jointed clamp serves not only as a clamp for the hook portions of the garment hanger, but also serves to support the garments, whereas in the patented arrangement the latter were supported externally on a rod, hook, or the like. When hookless garment hangers are used the lower channel of the clamp supports the garments therefrom.

The jointed clamp shown in the drawings is comprised of upper and lower channels 40 and 50, respectively, which are pivotally joined at one end by means of rivet 65, which extends beyond the external walls of the channels. A sleeve 66 surrounds the rivet between the internal walls of the channels to reenforce the pivotal joint. The clasp C at the opposite end is reenforced by flattening the ends 62' of the wire loop 61 at its terminals 62 to prevent its spreading and disengagement from the upper channel.

The upper channel 40 is provided with a web 41 and lateral walls 42 extending therefrom which form an open face opposite web 41. The complemental lower channel 50 is displaced congruously to the upper channel 40 and consists of the web 51 and opposed lateral walls 52 to present an open face above the web. The blocks 45 and 55, of resilient or yieldable material such as rubber, are seated in each of the respective channels for most of their length, and portions thereof protrude beyond the open faces of the channels. The walls 42 and 52 of the channels are provided with transverse slots 48 adjacent the ends of the blocks to facilitate the turning of the terminal edges of the lateral walls to bite into the surfaces of blocks 45 and 55 along the open faces, without distorting the alignment between the components of the clamp.

Also, the edges of the lateral walls at the transverse slots 48 may be turned down to retain securely the blocks 45 and 55 within the respective channels. The retention of the resilient blocks within the channels may be reenforced by indentations or dimples in one or both lateral walls of each channel which become embedded in the lateral surfaces of the resilient blocks, as disclosed in our earlier patent.

In order to facilitate the loading and unloading of the garments in the open position of the bag, the block 55 of resilient material, in the lower channel of the clamp is roughened on its upper face to present a frictional drag to the movement of the hooks of the hangers when the clamp is inclined. Thus, as shown in FIG. 8, the upper face of the resilient block 55 is provided with transverse grooves 56 which impede the movement of the hooks of the hangers therealong.

Figure 9:
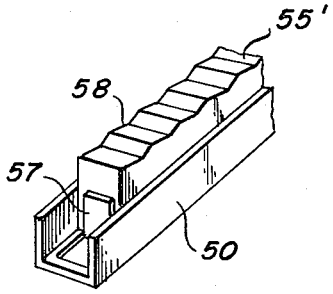
FIG. 9 is a perspective view of a different embodiment of the resilient block confined within the lower channel.

In FIG. 9, the upper face is provided with serrations 58 in rubber block 55' which serve the same purpose as the grooves 56. Any other form of roughening, such as knurling, may be used.

Figure 8:
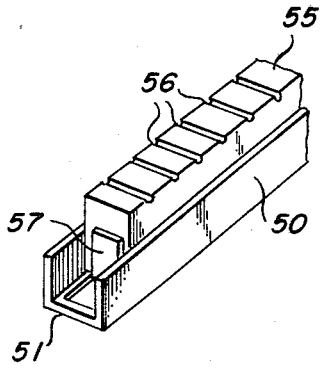
FIG. 8 is a perspective view of the front portion of the lower channel.

In both embodiments illustrated in FIGS. 8 and 9, the resilient blocks 55 and 55' are retained in the lower channel 50 by means of a vertical tab 57 which is stamped upwardly from the front portion of the web 51. This tab prevents a creeping of the resilient blocks in a forward direction, which may be occasioned by the rocking movement of a vertical stem extending through the channels adjacent to their rear ends, as described in greater detail hereinafter.

The tabs 57 may be used alternatively to the compression of the resilient blocks within the channels by deforming the lateral walls thereof, aided by slots 48 and the turning of the edges, as described above, or may supplement the action of these expedients.

In order to make possible the utilization of the garment bag unit in accordance with the invention with hookless hangers which may be found in hotels and motels, the web 51 of the bottom channel 50 is provided with an elongate keyhole slot 75 having an enlargement 76 which accommodates the bulbous enlargement or protuberance 78 at the upper end of the stem 77 of a hookless hanger to be inserted therethrough for sliding movement along the slot 75. Of course, a longitudinal recess 79 is cut out of the bottom face of the resilient block 55 to permit the protuberance 78 to move along the bottom of the channel. The enlargement 78 may be spherical, ellipsoidal, cylindrical or other outline, as long as it is capable of passing through the opening 76 and to be confined against withdrawal by the narrowed length 75 of the keyhole slot. The handle 89 adjacent to opening 76 (FIG. 3) prevents accidental dislodgement of the hangers.

The instant invention provides a simplified stop mechanism for restricting the angular movement between the pivoted channels of the clamp, which is illustrated in FIGS. 3, 4 and 6. A vertical stem 46, resembling a rivet with flanged caps 47 at its ends, extends loosely between the webs 41 and 51 of the pivoted channels 40,50, respectively, slightly in front of the hinged joint 65,66. When the clasp C is released at the front thereof, which permits the lower channel to be tilted downwardly, the stem 46 is rocked from its vertical position until the rear portion of its lateral wall strikes the sleeve 66 of the hinged joint which arrests the rocking movement of the stem as shown in FIG. 4. This movement may be restricted to 15° or to any other angle which is sufficient to afford space for the movement of the garment hanger hooks between the jaws of the clamp, preparatory to the clamping thereof in a horizontal position as shown in full lines in FIG. 3.

The rear walls of the resilient blocks 45 and 55 are grooved with a semicylindrical depression to accommodate the rockable stem 46. The tab 57 at the front of channel 50 effectively arrests the forward movement of the block 55 which may be occasioned by the rocking movement of the stem 46.

Figure 10:
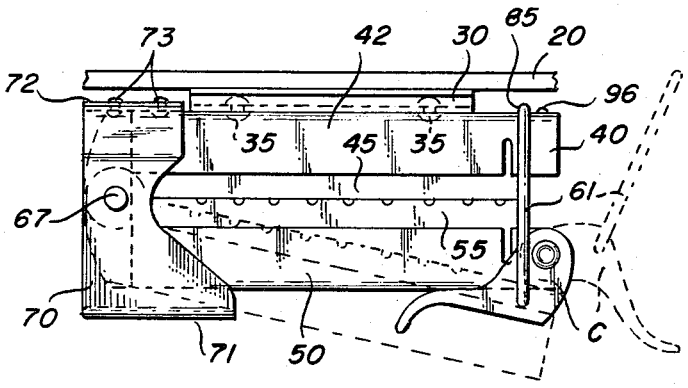
FIG. 10 is a side elevation of a modified form of clamp having a continuous frame at the rear portion thereof.
Figure 11:
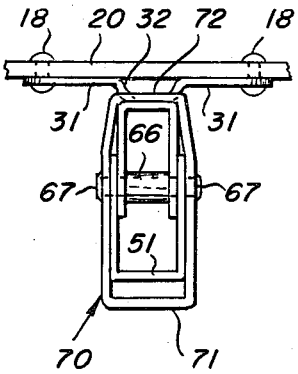
FIG. 11 is a left end view of FIG. 10.

In FIGS. 10 and 11 is illustrated another means for restricting the tilting movement of the lower channel. In this construction, a continuous band 70 surrounds the clamp at the rear portion thereof. The top wall 72 of the band may be riveted, brazed, soldered or welded to the rear portion of the web 41 of the upper clamp 40. The bottom wall 71 is displaced from the web 51 of the lower clamp 50 in an amount sufficient to permit limited tilting movement of the lower channel. The confining band as well as the hinged joint is further reenforced by extending the hinge pin 65 beyond the lateral walls of the band 70 and upsetting them at flanges 67 (FIG. 11), which complements the reenforcement afforded by the sleeve 66 extending between the internal lateral walls of the channels.

The clasp C at the front end of the clamp for closing the latter is identical to that disclosed in our earlier U.S. Pat. No. 4,252,220. The lateral wings 87 and 88 embrace the free end of channel 50. The wings are pivotally mounted on the channel by means of a pintle 83 to permit the rotation of the clasp by means of the handle 89 interconnecting the wings wherefrom extends the finger piece 90.

A wire retaining hook 61, closed at one end 85 and provided with lateral arms 62 at the opposite end, is seated within aligned openings in the wings 87 and 88 at the bail of the clasp C. Upon swinging the loop 61,85 into engagement with a retaining protuberance 96 adjacent the forward edge of the end wall of channel 40, the clasp may be closed and tightened with great force by virtue of the eccentric mounting of the clasp on pintle 83 and the high mechanical efficiency attained therefrom. The open position of the clasp is shown in dotted lines in FIG. 3, which upon rotation in a clockwise direction, serves to tightly clamp together the channels 50 and 40, to compress and retain the hooks of any hangers which may be interposed between the protruding portions of the resilient blocks 55 and 45.

The stresses imposed upon the wire loop 61,62,62' when it embraces a large number of garment hangers, cause spreading of the arms 62 and the occasional withdrawal of the transverse ends thereof from the openings in the wings of the bail. This tendency is prevented by flattening the free ends 62' of the arms 62 following their insertion into the aligned openings of the bail.

We claim:

1. A frame type garment bag unit having means on the outside of the top thereof for suspending the bag while loading therein or unloading therefrom a plurality of garments on hangers therefor, which may alternatively be of the type having a vertical wire shank extending upwardly from the center of the hanger and terminating in a downwardly extending curved hook portion, or a vertical wire shank having a bulbous enlargement at the upper end thereof, comprising, (a) a jointed clamp disposed in a generally vertical plane and having an upper channel fixed to the garment bag and a lower channel pivotally mounted to said upper channel at the rear ends thereof, with the open edge of each channel facing the other, (b) a horizontally disposed hinge pin at said rear ends extending beyond the external surfaces of said channels, (c) a reenforcing sleeve surrounding said hinge pin between the internal surfaces of said channels, (d) a strip of resilient material seated within each channel and protruding beyond the open edge thereof, (e) a latching device of high mechanical efficiency at the front end of said jointed clamp for alternately permitting the spreading of said channels or the clamping thereof together, for embracing the hook portions of the garment hangers to maintain them in fixed position, (f) means extending between said last-mentioned upper channel and said lower channel for limiting the pivotal movement of the latter in the open position of said jointed clamp, to provide an inclined support for the hook portions of the garment hangers in the course of loading and unloading the latter into and from the garment bag, and (g) the bottom wall of said lower channel having an elongated keyhole-shaped slot for permitting the insertion and withdrawal of hangers having wire shanks with bulbous enlargements, to render the garment bag universally adaptable for enclosing garments on both types of hangers.

2. A device as set forth in claim 1, wherein the upper face of the resilient strip seated in the lower channel has a high coefficient of friction to retard the movement of the hook portions of the hanger towards the front of the garment bag in the downwardly inclined position of said last-mentioned channel.

3. A device as set forth in claim 2, wherein the upper face of the resilient strip is provided with a plurality of spaced notches extending transversely of the strip.

4. A device as set forth in claim 2, wherein the upper face of the resilient strip is serrated.

5. A device as set forth in claim 1, wherein the keyhole-shaped slot is arranged with its enlarged end towards the front end of the channel.

6. A device as set forth in claim 1, wherein said last-mentioned means comprises a vertical stem extending between the end walls of the pivoted channels at a slight forward displacement from said hinge pin, which is adapted to arrest the pivotal movement of the lower channel when the movable stem strikes the hinge pin.

7. A device as set forth in claim 1, wherein said last-mentioned means comprises an enclosure of substantially rectangular cross-section surrounding the rear portions of said channels, the upper wall of said enclosure being affixed to the top of the wall of said upper channel and the lower wall of said enclosure displaced from the bottom wall of said lower channel to limit the rocking movement of the latter.

8. A device as set forth in claim 7, wherein the lateral walls of said enclosure embrace the outer lateral walls of said channels, with the hinge pin extending through the outer lateral walls of said enclosure.

9. A device as set forth in claim 7, wherein said enclosure has a continuous and integral periphery.

10. A device as set forth in claim 8, wherein the rear end of each of the strips of resilient material is provided with a vertical recess to accommodate the forward portion of said stem.

11. A device as set forth in claim 6, including a vertical tongue stamped from the end wall of the lower channel at the front thereof for providing a retaining stop for the lower strip of resilient material.

12. A device as set forth in claim 2, including a vertical tongue stamped from the end wall of the lower channel at the front thereof to prevent creeping of the strip along the channel.

13. A device as set forth in claim 2, wherein the lower face of the resilient strip in the lower channel is provided with a groove adjacent to said slot to permit free movement of the hookless hangers therealong.

14. A device as set forth in claim 8 including retaining flanges at the outer ends of said hinge pin and in contact with the lateral walls of said enclosure.

* * * * *

UNITED STATES PATENT AND TRADEMARK OFFICE

CERTIFICATE OF CORRECTION

PATENT NO. : 4,363,388

DATED : December 14, 1982

INVENTOR(S) : Wallace London and Kurt L. Meyer

It is certified that error appears in the above-identified patent and that said Letters Patent is hereby corrected as shown below:

Claim 10, column 7, line 5, "8" should be --6--.

Signed and Sealed this

*Twenty-second* Day of *March 1983*

[SEAL]

*Attest:*

GERALD J. MOSSINGHOFF

*Attesting Officer*

*Commissioner of Patents and Trademarks*